US008789900B2

(12) United States Patent
Laible et al.

(10) Patent No.: US 8,789,900 B2
(45) **Date of Patent: *Jul. 29, 2014**

(54) DOOR FOR A HOUSEHOLD APPLIANCE

(75) Inventors: Karl-Friedrich Laible, Langenau (DE); Helmut Steichele, Lauingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 102 days.

This patent is subject to a terminal disclaimer.

(21) Appl. No.: 11/919,720

(22) PCT Filed: Apr. 3, 2006

(86) PCT No.: PCT/EP2006/061269

§ 371 (c)(1),
(2), (4) Date: Oct. 30, 2007

(87) PCT Pub. No.: WO2006/120082

PCT Pub. Date: Nov. 16, 2006

(65) Prior Publication Data

US 2009/0045705 A1 Feb. 19, 2009

(30) Foreign Application Priority Data

May 10, 2005 (DE) ..... 10 2005 021 607

(51) Int. Cl.
*A47B 17/04* (2006.01)

(52) U.S. Cl.
USPC ..... 312/204

(58) Field of Classification Search
USPC ..... 312/226, 227, 326–329, 204, 265.5, 312/265.6, 348.3; 403/326, 329
See application file for complete search history.

(56) References Cited

U.S. PATENT DOCUMENTS

| | | | | | |
|---|---|---|---|---|---|
| 1,668,595 | A * | 5/1928 | McAuliffe | 312/227 |
| 1,802,552 | A * | 4/1931 | Corcoran | 292/166 |
| 1,892,491 | A * | 12/1932 | Mastrangelo et al. | 49/253 |
| 2,402,717 | A * | 6/1946 | Winer | 428/83 |
| 3,597,753 | A * | 8/1971 | Tabankin | 340/539.31 |
| 4,148,454 | A * | 4/1979 | Carlson et al. | 248/222.11 |
| 4,457,436 | A * | 7/1984 | Kelley | 211/88.01 |
| 4,514,021 | A | 4/1985 | Sundermeier et al. | |
| 5,358,326 | A | 10/1994 | Cherry et al. | |
| 6,293,726 | B1 * | 9/2001 | Wolf | 403/299 |
| 7,434,304 | B2 * | 10/2008 | Owens | 29/525.01 |
| 2004/0183413 | A1 * | 9/2004 | Koo | 312/401 |
| 2004/0222725 | A1 * | 11/2004 | Park et al. | 312/405 |
| 2007/0188059 | A1 * | 8/2007 | Davis et al. | 312/265.6 |
| 2008/0129165 | A1 * | 6/2008 | Chen et al. | 312/263 |
| 2008/0252186 | A1 * | 10/2008 | Crompton et al. | 312/204 |
| 2009/0251036 | A1 * | 10/2009 | Laible et al. | 312/326 |

FOREIGN PATENT DOCUMENTS

| | | | |
|---|---|---|---|
| DE | 75 20 916 | U | 11/1975 |
| DE | 3425991 | C1 | 10/1985 |
| DE | 4200333 | * | 7/1992 |

(Continued)

*Primary Examiner* — Janet M Wilkens
(74) *Attorney, Agent, or Firm* — Nixon & Vanderhye, P.C.

(57) ABSTRACT

A door for a household appliance is provided. The door includes a door outer skin; a decorative panel attached to the door outer skin, the decorative panel and the door outer skin being separated by an intermediate space; a gap located in the intermediate space, the gap being formed on and parallel to the decorative panel or the door outer skin; and an angle piece having a first limb and a second limb. The decorative panel and the door outer skin are connected together by the angle piece, the first limb engages the gap, and the second limb is attached to an edge of the door outer skin or the decorative panel.

30 Claims, 2 Drawing Sheets

(56) References Cited

FOREIGN PATENT DOCUMENTS

| | | | |
|---|---|---|---|
| EP | 108677 | * | 10/1983 |
| EP | 647821 | * | 10/1994 |
| EP | 0 857 929 | | 8/1998 |
| EP | 1 245 916 | | 10/2002 |
| GB | 126578 | | 5/1919 |
| GB | 2050814 | * | 5/1980 |
| JP | 2006020832 | * | 1/2006 |

* cited by examiner

DOOR FOR A HOUSEHOLD APPLIANCE

BACKGROUND

This application is U.S. National Phase of International Application No. PCT/EP2006/061269, filed on Apr. 3, 2006 and claims priority to German Patent Application No. 102005021607.2, filed on May 10, 2005, the entire contents of each which are hereby incorporated by reference.

The present invention relates to a door for a household appliance such as a refrigerator, a freezer, a dishwasher, or similar.

In the case of household appliances which are integrated in kitchen furniture or installed adjacent thereto, the design of the door is often matched to the adjacent doors of the kitchen furniture. In order to achieve an exactly flush alignment of the furniture doors and the visible parts of the appliance doors, the latter are generally constructed of multiple parts comprising an appliance-side panel, which performs the technical functions of the sealing of an internal space of the household appliance and is usually preassembled on the appliance as supplied by the manufacturer, and a decorative panel, which is subsequently mounted on the appliance-side panel with the aid of adjustable adapters after the household appliance is installed in its intended place of use. In the case of integrated appliances, the edge length of the decorative panel is generally a few centimeters longer than the appliance-side panel, since the decorative panel must cover not just the appliance-side panel but the whole furniture slot in which the appliance is installed.

In order to attach the decorative panel to the appliance-side panel, use is normally made of angle pieces in which one limb fits closely against a side edge of the appliance-side panel and a second limb is screwed onto the decorative panel in each case, said second limb being parallel with the front side of the appliance-side panel and projecting outward beyond the edge thereof.

In the case of a household appliance which is not designed for installation in a furniture slot, but instead is intended to stand alongside furniture or other household appliances, it is neither necessary nor appropriate for a decorative panel of such an appliance to project laterally beyond the body of the appliance. If such a decorative panel is to be mounted in the conventional manner for integrated household appliances as described above, the problem arises that the screws by means of which the decorative panel is attached to the angle pieces must be positioned very near to the edges of the decorative panel. As a result there exists a risk that the material of the decorative panel might split when the screws are inserted or at a later time if the decorative panel is subjected to mechanical stress, and the decorative panel might become unusable.

SUMMARY

The object of the invention is to enable a decorative panel to be attached to the door front of a household appliance by means of simple structural measures, without the risk of damaging the decorative panel.

The object is achieved by a door for a household appliance, in particular an integrated household appliance having a door outer skin and a decorative panel which can be attached to the front side of the door, these being attached to each other and separated by an intermediate space, characterized in that at least one gap which is parallel with the decorative panel or the door outer skin is formed on the decorative panel or the door outer skin in the intermediate space, and that the decorative panel and the door outer skin are connected together by means of an angle piece, of which a first limb engages in the gap and a second limb is attached to an edge of the door outer skin or the decorative panel. As a result of the inventive attachment of the decorative panel to the door outer skin, the former is fixed to the door outer skin such that its positioning is secure and durably accurate. As a result of the positive attachment, disassembly and reassembly is possible without signs of damage or assembly on the decorative panel or the door outer skin. As a result of the attachment measure, the decorative panel can also be subjected to mechanical stress without sustaining damage.

In order to facilitate the introduction of the first limb of the angle piece, the gap is preferably open toward an adjacent edge of the appliance-side panel or the decorative panel.

The gap is preferably delimited on one side by the decorative panel and on the other side by a bridge which is attached thereto. The bridge is preferably formed into a curved shape from sheet metal.

In order to allow an adjustment movement of appliance-side panel and decorative panel relative to each other in a longitudinal direction of the bridge, even when the first limb of the angle piece is engaged in the gap which is formed under the bridge, the bridge preferably has a span of at least one and a half times the width of the first limb, such that this can be moved by half of its width in the gap.

In order to allow an adjustment movement perpendicular to the main surfaces of the panels, the second limb is preferably provided with an elongated hole.

A bead in the first limb, said bead being oriented toward the bridge, increases the stiffness thereof and facilitates the frictional insertion of the limb into the gap.

BRIEF DESCRIPTION OF THE DRAWINGS

Further features and advantages of the invention are derived from the following description of exemplary embodiments with reference to the attached figures, in which.

DETAILED DESCRIPTION

Figure 1:
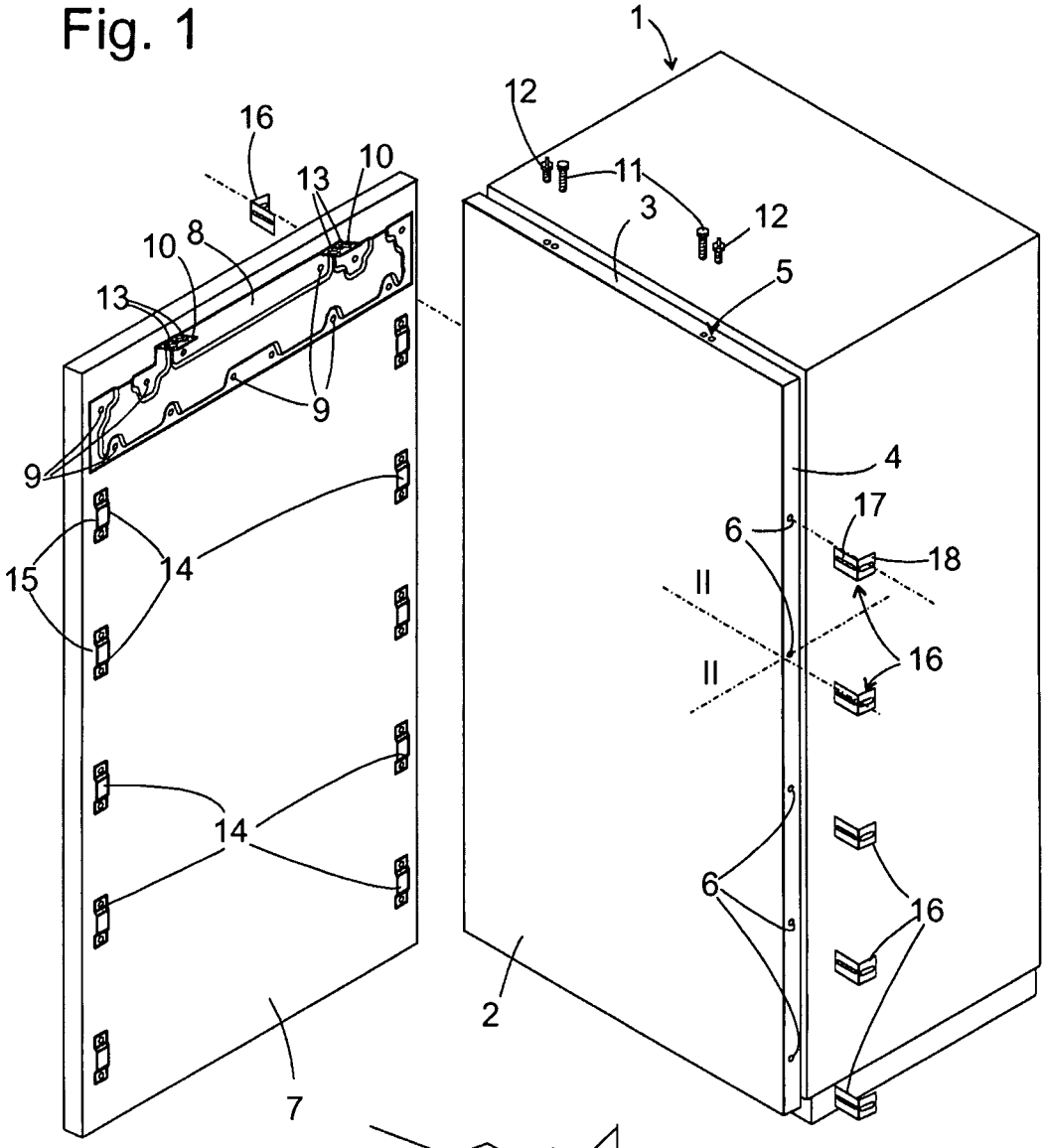
FIG. 1 shows a perspective partially exploded view of a household appliance including a door in accordance with the present invention.

FIG. 1 shows a perspective view of a refrigerator having a body unit 1 and an appliance-side door panel 2 which is attached thereto and in its closed position. The appliance-side door panel 2 is designed in a conventional manner as a hollow body which is filled with a foamed polymer material and has a strong outer skin. A plurality of threaded blind holes 5, 6, these being sealed against the foamed polymer material, are formed in each case in a top edge 3 and in side edges 4.

A wooden decorative panel 7 is illustrated separately from the appliance-side door panel 2 on which it will be mounted. The figure shows the rear side of the decorative panel 7, this being oriented toward the door panel 2 in the assembled state. An adjustment strip 8 made of sheet metal is attached in the upper region of the decorative panel 7 using a plurality of screws 9. The adjustment strip 8 has a base plate which fits closely against the decorative panel 7 and is stiffened by a flat rib and two brackets which project perpendicularly from the top edge of the base plate and have in each case two openings. These openings serve to attach the decorative panel 7 to the top edge 3 of the appliance-side door panel 2 with the aid of screws 11 or 12. The screws 11 are conventional screws having a threaded shaft and a head; the screws 12 are special screws having a threaded shaft, a head and a pin which extends upward from the head. The screws 11, 12 are dimensioned such that their heads do not pass through the openings 13 of the brackets 10, but that their shaft or pin (in the case of the screw 12) does. Firstly, the two screws 12 are screwed into their assigned threaded holes 5, and the decorative panel 7 is then hung onto the screws 12 in such a way that their pins pass through their assigned openings 13 and the brackets 10 rest on the heads of the screws 12. The height of the decorative panel 7 can be adjusted by turning the screws 12; the lateral position of the decorative panel 7 and its distance from the appliance-side door panel 2 can be adjusted by moving the brackets 10 on the heads of the screws 12. When the height of the decorative panel 7 is found to be correct, it can be fixed by fastening the screws 11.

A plurality of bridges 14 formed of sheet metal in a curved shape are screwed onto the rear side of the decorative panel 7 adjacent to its side edges, said bridges together with the decorative panel 7 delimiting in each case a gap 15 which is open toward the adjacent edge. The gaps 15 are provided in order to frictionally receive in each case a first limb 17 of an angle piece 16, this being formed from sheet metal like the bridges 14, of which in each case a second limb 18 is screwed to one of the threaded holes 6 of one of the side edges 4 of the panel 2.

Figure 2:
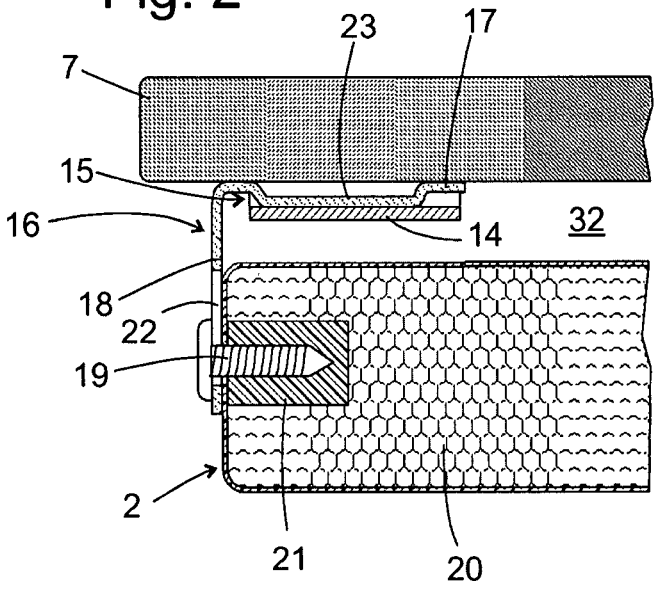
FIG. 2 shows a horizontal part-section, in the plane which is designated by the dash-dotted line II-II in FIG. 1, in the finished assembled state.

The attachment of the angle pieces 16 to the decorative panel 7 and the appliance-side door panel 2 is more clearly identifiable with reference to FIG. 2, which shows a horizontal part-section through the assembled door at the level of the plane which is defined by dash-dotted lines II in FIG. 1. In the present example the decorative panel projects laterally beyond the edge of the appliance-side panel 2 by approximately 1 to 2 cm, though the projection can also be greater or smaller, or even non-existent.

The angle piece 16 is held to the side edge of the panel 2 by means of a screw 19, this engaging in the threaded hole 6 which is formed in a plastic sleeve that projects into the insulating polymer material 20 of the door panel 2. The screw 19 passes through an elongated hole of the limb 18, such that the distance between the appliance-side panel 2 and the limb 17 and hence the width of the intermediate space 32 between the panels 2, 7 can be adjusted by moving the screw 19 and elongated hole 22 relative to each other.

The limb 17 with formed bead 23 frictionally fills the gap 15 and can be moved within said gap both in a longitudinal direction of the limb 18 and, since the gap 15 is wider than the limb 18, transversely relative thereto. Consequently, the connection between the panels 2, 7 can be adjusted in three spatial directions by means of the angle piece 16 and the bridge 14.

The angle pieces 16 are positioned and adjusted after the decorative panel 7 has been hung on the top edge of the appliance-side door panel 2 by means of the adjustment strip 8 and adjusted relative to height.

Figure 3:
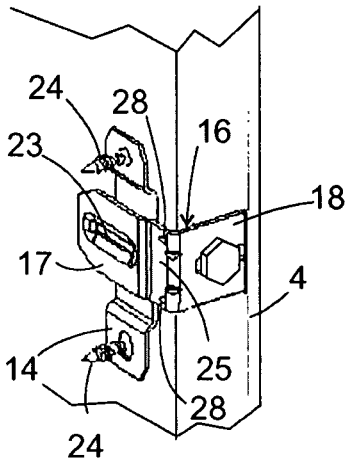
FIG. 3 shows a detail enlargement from FIG. 1 according to a developed embodiment.

FIG. 3 shows a perspective view of an angle piece 16, which is attached to a side edge 4 of the panel 2, and the bridge 14 which is assigned thereto, without the decorative panel 7 to which the bridge 14 is attached by means of screws 24. The angle piece 16 according to this second embodiment differs from that shown in FIG. 2 by virtue of an intermediate section 25 which connects the limbs 17, 18 together and is offset parallel slightly relative to the limb 18 such that, when the limb 18 is inserted into the gap between bridge 14 and decorative panel 7 and fits closely against the decorative panel 7, it acts with the decorative panel 7 to delimit a groove 26 which is open toward the edge of said decorative panel.

Figure 4:
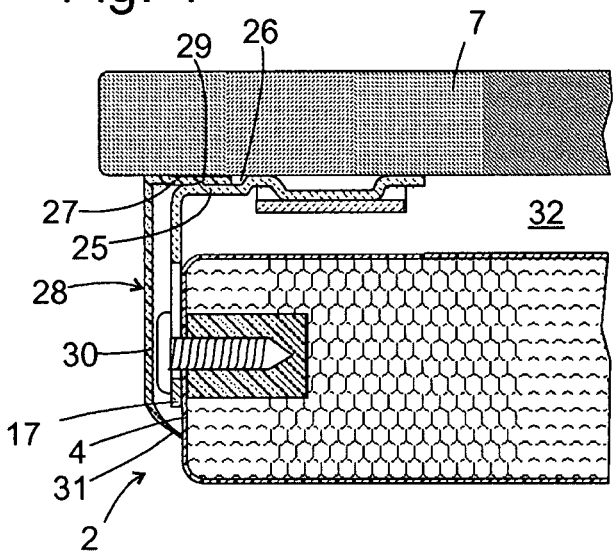
FIG. 4 shows a horizontal section similar to FIG. 2 according to the developed embodiment.

As illustrated in FIG. 4, which shows a section that is analogous to that in FIG. 2, a tongue 27 of a plastic extruded profile 28 is inserted into this groove 26 and secured against slipping out by means of claws 29 which are formed in the intermediate section 25. A ridge 30 of the extruded profile extends away from the decorative panel 7 along the side edge 4 and beyond the end of the limb 17. A curved tapering and hence flexible end section 31 of the ridge 30 fits tightly against the edge 4.

The extruded profile 28 extends over the entire height of the door panel 2 and hence conceals all angle pieces 16 and the intermediate space 32 between the panels 2, 7 in which the limbs 17 of the angle pieces 16 engage.

Because the bridges 14 in both embodiments are located entirely in the intermediate space 32 between the two panels, the distance between the edges of the decorative panel 7 and the screws 24 which engage therein and secure the bridges 14 is necessarily greater than the lateral projection—if present—of the decorative panel 7 beyond the appliance-side panel 2. It can therefore always be selected to be large enough to reliably avoid any damage or risk to the decorative panel 7 as a result of inserting the screws 24.

The invention claimed is:

1. A door for a household appliance, comprising:

a door outer skin;

a decorative panel attached to the door outer skin, the decorative panel and the door outer skin being separated by an intermediate space;

a bridge attached to the decorative panel or the door outer skin and located in the intermediate space, the bridge forming a gap between the bridge and the decorative panel or the door outer skin, the gap being parallel to the decorative panel or the door outer skin; and an angle piece having a first limb and a second limb, wherein the decorative panel and the door outer skin are connected together by the angle piece, the first limb engages the gap, a distal end of the first limb being oriented away from a nearest peripheral edge of the decorative panel, and the second limb is attached to an edge of the door outer skin or the decorative panel, wherein the second limb comprises;

a first surface that is disposed towards the door outer skin or the decorative panel where the second limb is attached; and a second surface opposite the first surface and defining a thickness of the second limb together with the first surface, wherein all of the angle piece is inward of the second surface with respect to a nearest outer edge of the decorative panel.

2. The door as claimed in claim 1, wherein the gap is open toward an adjacent side edge of the decorative panel or to a side edge of the door outer skin.

3. The door as claimed in claim 1, wherein one side of the gap is delimited by the bridge and the other side of the gap is delimited by the decorative panel or the door outer skin.

4. The door as claimed in claim 3, wherein the bridge is configured in a shaped part and is essentially U-shaped.

5. The door as claimed in claim 4, wherein the span of the bridge is defined by the spacing between two U-limbs of the bridge.

6. The door as claimed in claim 3, wherein the bridge has a span of at least one and a half times a width of the first limb.

7. The door as claimed in claim 3, wherein the first limb includes a bead oriented toward the bridge.

8. The door as claimed in claim 3, further comprising a plurality of bridges provided at vertical side edges of the decorative panel or the door outer skin.

9. The door as claimed in claim 1, wherein the second limb includes an elongated hole.

10. The door as claimed in claim 1, wherein the gap is arranged on the decorative panel.

11. The door as claimed in claim 1, wherein the first limb comprises a bead with a length that is longer than a width, the length being along a direction of insertion of the first limb into the gap and at least partially within the gap.

12. The door as claimed in claim 11, wherein the first limb frictionally engages the bridge within the gap by way of the bead.

13. The door as claimed in claim 1, wherein the angle piece has an overall L-shape.

14. The door as claimed in claim 1, wherein the door is for a household appliance that is not installed in a furniture slot.

15. The door as claimed in claim 1, wherein the decorative panel does not project laterally beyond a body of the household appliance.

16. A door for a household appliance, comprising:

a door outer skin;

a decorative panel attached to the door outer skin, the decorative panel and the door outer skin being separated by an intermediate space;

a bridge attached to the decorative panel or the door outer skin, and, as seen from a front side of the door, the bridge is located completely between the decorative panel and the door outer skin in the intermediate space, the bridge forming a gap between the bridge and the decorative panel or the door outer skin, the gap being parallel to the decorative panel or the door outer skin; and an angle piece having a first limb and a second limb, wherein the decorative panel and the door outer skin are connected together by the angle piece, the first limb engages the gap, a distal end of the first limb being oriented away from a nearest peripheral edge of the decorative panel, and the second limb is attached to an edge of the door outer skin or the decorative panel wherein the second limb comprises;

a first surface that is disposed towards the door outer skin or the decorative panel where the second limb is attached; and a second surface opposite the first surface and defining a thickness of the second limb together with the first surface, wherein all of the angle piece is inward of the second surface with respect to a nearest outer edge of the decorative panel.

17. The door as claimed in claim 16, wherein the gap is open toward an adjacent side edge of the decorative panel or to a side edge of the door outer skin.

18. The door as claimed in claim 16, wherein one side of the gap is delimited by the bridge and the other side of the gap is delimited by the decorative panel or the door outer skin.

19. The door as claimed in claim 18, wherein the bridge is configured in a shaped part and is essentially U-shaped.

20. The door as claimed in claim 19, wherein the span of the bridge is defined by the spacing between two U-limbs of the bridge.

21. The door as claimed in claim 18, wherein the bridge has a span of at least one and a half times a width of the first limb.

22. The door as claimed in claim 18, wherein the first limb includes a bead oriented toward the bridge.

23. The door as claimed in claim 18, further comprising a plurality of bridges provided at vertical side edges of the decorative panel or the door outer skin.

24. The door as claimed in claim 16, wherein the second limb includes an elongated hole.

25. The door as claimed in claim 16, wherein the gap is arranged on the decorative panel.

26. The door as claimed in claim 16, wherein the first limb comprises a bead with a length that is longer than a width, the length being along a direction of insertion of the first limb into the gap and at least partially within the gap.

27. The door as claimed in claim 26, wherein the first limb frictionally engages the bridge within the gap by way of the bead.

28. The door as claimed in claim 16, wherein the angle piece has an overall L-shape.

29. The door as claimed in claim 16, wherein the door is for a household appliance that is not installed in a furniture slot.

30. The door as claimed in claim 16, wherein the decorative panel does not project laterally beyond a body of the household appliance.

* * * * *